United States Patent [19]

Facey

[11] 3,948,308

[45] Apr. 6, 1976

[54] FOLDABLE STORM WINDOW AND SCREEN

[76] Inventor: Stanley R. Facey, 1182 Herkimer St., Brooklyn, N.Y. 11233

[22] Filed: Mar. 12, 1974

[21] Appl. No.: 450,406

[52] U.S. Cl. ..... 160/369; 160/90; 160/353

[51] Int. Cl.[2] ..... A47H 3/00; A47G 5/00

[58] Field of Search ..... 160/87, 89, 90, 92, 130, 160/181, 182, 186, 353, 368, 369, 379

[56] References Cited

UNITED STATES PATENTS

| | | | |
|---|---|---|---|
| 1,763,897 | 6/1930 | Leindorf et al. | 160/92 |
| 1,837,135 | 12/1931 | Pousha et al. | 160/90 |
| 2,269,817 | 1/1942 | Horton | 160/353 |
| 2,365,238 | 12/1944 | Anderson | 160/90 |
| 2,502,665 | 4/1950 | O'Drago | 160/328 |
| 3,009,515 | 11/1961 | Albee, Jr. | 160/369 |

*Primary Examiner*—Paul R. Gilliam
*Assistant Examiner*—Victor N. Sakran
*Attorney, Agent, or Firm*—Friedman & Goodman

[57] ABSTRACT

A foldable storm window or screen particularly adapted for placing in position around a window opening from within the building without removing the sashes.

Said invention may be assembled and installed by non-professional persons and is advantageous in that it is made larger than the window, overlaping the edges and eliminating the need of customizing.

5 Claims, 8 Drawing Figures

FIG.1
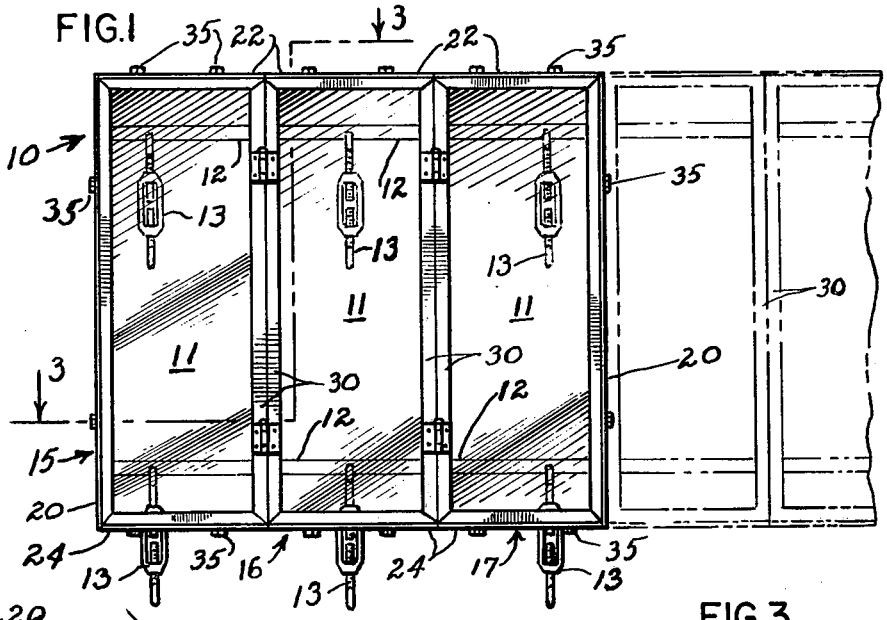
FIG.2
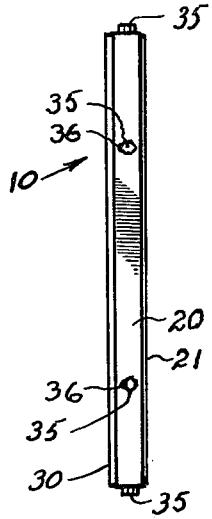
FIG.3
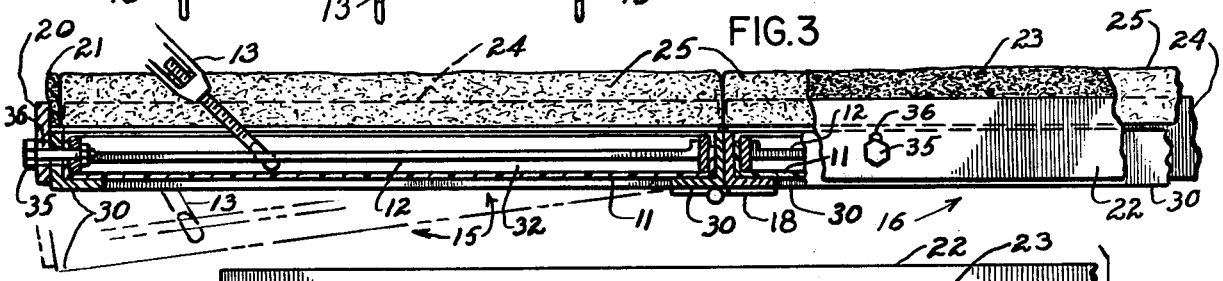
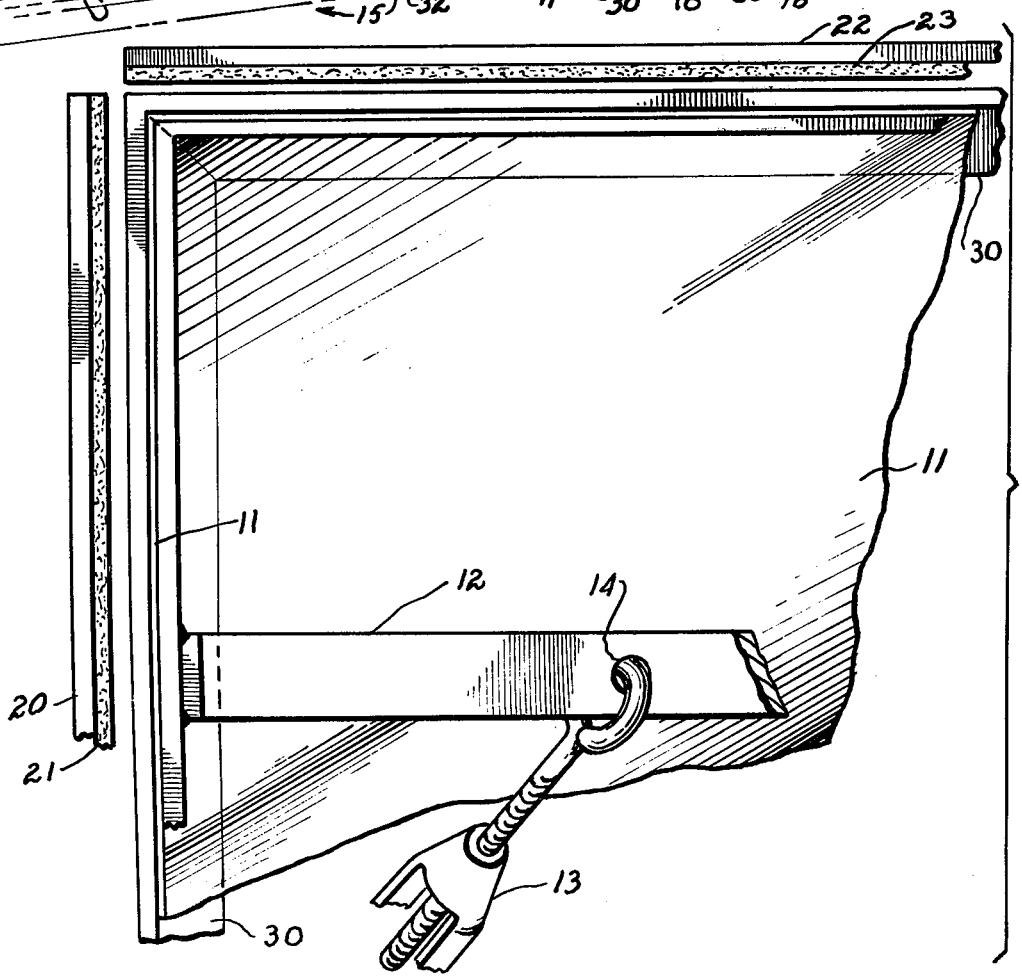
FIG.4

37
36
23
35
22
38
39
30
11
32
50
21
20

38
38
42
43
40
41
32
43
44
38
13
38

50
36
36
51
51
25
51
18
35
18
24
35
36
35
13
25
36
24
35
36
36
13
13

35
51
13
22
35
5
20
22
10
20
12
18
13
21
18
5
12
35
15
50
11
11
11
30
51
18
12
13
13
30
24
51
16
30
17
24

FOLDABLE STORM WINDOW AND SCREEN

BRIEF SUMMARY OF THE INVENTION

It is the object of this invention to provide an inexpensive, foldable storm window or screen that may be placed in operative position from within the building, thus obviating the necessity for climbing a ladder or other outside operations or for the removing the sashes.

Said invention may be assembled and installed by non-professional persons and is advantageous in that it is made larger than the window to overlap and seal against the building thus eliminating the need of customizing.

Another feature of my invention is that a damaged insulating or screening material can be replaced by the lay person without professional help.

The possibility of additional panels to cover wider areas is another feature.

FIGURE DESCRIPTIONS

FIG. 1. Front elevation view.

FIG. 2. Side elevation view.

FIG. 3. Partial sectional top plan view taken on line 3—3 of FIG. 1.

FIG. 4. Partially exploded fragmentary rear elevational view.

Figure 5:
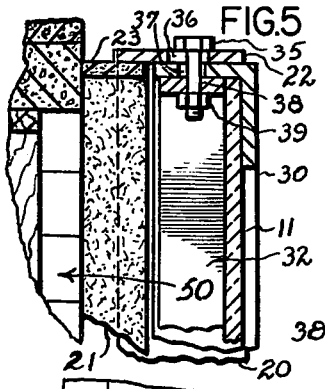

FIG. 5. Sectional view taken on line 5—5 of FIG. 8.

Figure 6:
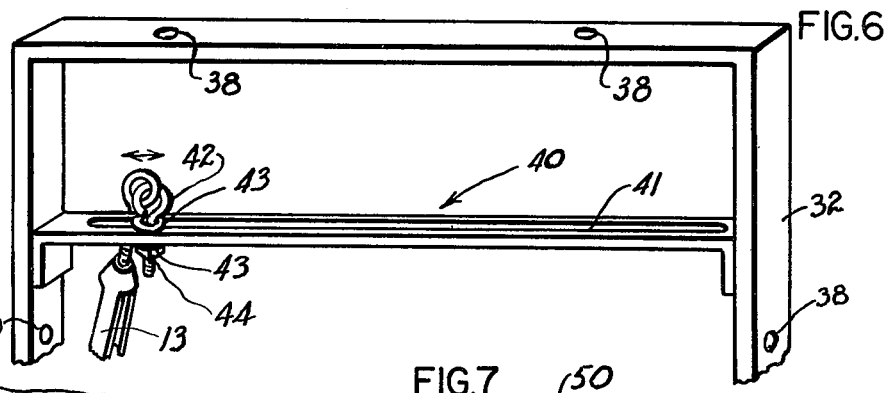

FIG. 6. Partial fragmentary perspective view of inner frame and modified form of an adjustable turnbuckle bracket.

Figure 7:
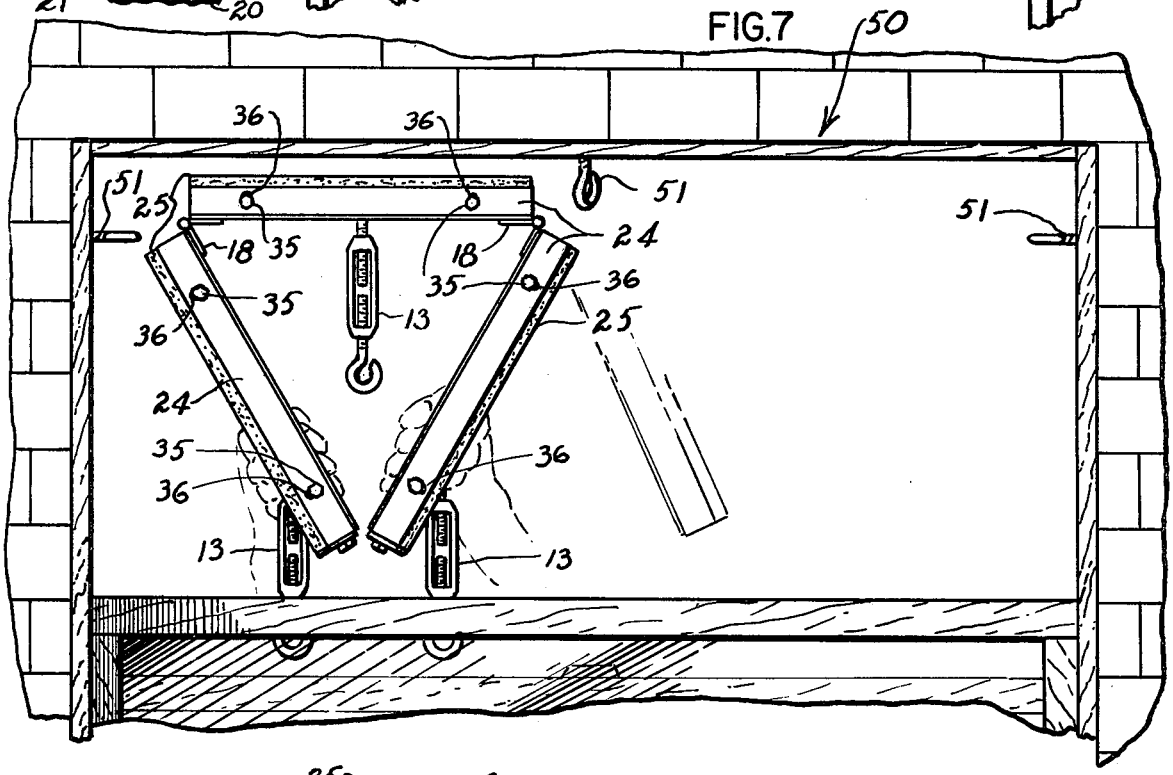

FIG. 7. Folded end elevational view showing possible convenient means of placing window in position from inside.

Figure 8:
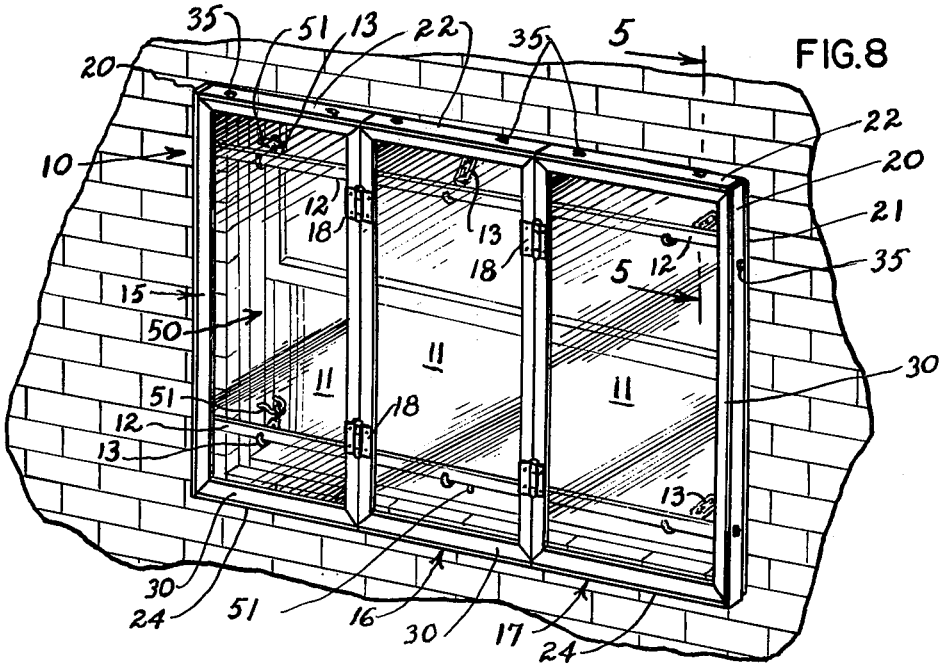

FIG. 8. Perspective view showing my invention in place.

DEFINITION OF NUMERALS IN FIGURE DESCRIPTIONS

10. Window unit. (consisting of panels 15, 16, 17.)
11. Transparent window material such as glass or plastic.
12. Turnbuckle bracket.
13. Turnbuckle.
14. Hole in turnbuckle bracket.
15. Outside panel.
16. Inside panel.
17. Outside panel.
18. Hinges.
20. Side seal adjustable plate.
21. Felt or rubber insulating material glued to the plate.
22. Top seal plates.
23. Top seal plate insulating material glued to the plate.
24. Bottom seal plates.
25. Bottom seal plate insulating material glued to the plate.
30. Outer frame.
32. Inner frame.
35. Seal plate securing bolt.
36. Adjusting slots in seal plates.
37. Adjusting slots in outer frame.
38. Bolt holes in inner frame.
39. Bolt nuts.
40. Modified turnbuckle bracket.
41. Slot in bracket.

42. Eye bolt.
43. Washers.
44. Eye bolt nut.
50. Window frame.
51. Screw hooks.

The window comprises a rectangular frame 30 of metal, plastic, etc., within which is rested a second rectangular frame 32 of same suitable material. In assembly, a selected transparent material 11, such as pliable plastic, rigid plastic, glass, plexiglass or screening is interchangeably placed according to the season within frame 30 and clamped therein by frame 32. Frame 32 is provided with slotted cross bars, which shall be referred to as turnbuckle brackets 12, affixed thereto adjacent the upper and lower parts. The turnbuckle brackets have an eye bolt 42 placed within the slot with a washer 43 around the bolt above the slot and a washer 43 around the bolt below the slot. The eye bolt is secured by an eye bolt nut 44. A mounting means such as a spring or turnbuckle 13 is attached to the eyebolt 42. This mounting means can move laterally on the turnbuckle bracket and be tightened where desired. The assembled panels are provided with hinge means to permit a plurality of panels to be pivotally attached together in the manner of an accordian or otherwise as shown in FIG. 1. Adjustable side seal plates 20 and adjustable top seal plates 22 and adjustable bottom seal plates 24 are provided. These seal plates all have adjusting slots 36. These plates have felt, rubber or any suitable insulating material glued to their edges. Side seal plate insulating material 21, top seal plate insulating material 23 and bottom seal plate insulating material 25. This resilient padding will account for small irregularities in the outer wall surfaces. Larger seal plates can account for greater irregularities such as shingles, clapboard, window sills and brick ornamentation. The seal plates are placed to their respective positions and the outer frame 30, the inner frame 32 and the seal plate are secured by seal plate securing bolts 35. Screw hooks 51, are screwed into the wood framework outside the house window. The storm window in Folded position FIG. 7 is passed through the opened upper half of the window, and the mounting means, turnbuckle 13 of an inner or center panel is hooked to its corresponding upper hook screw 51. The window sashes are raised and a lower inner or center panel turnbuckle is hooked to its corresponding hook screw. The turnbuckles are then adjusted so that the storm window is properly placed into position and tightened. A portion of the storm window is now securely fastened to the outside wall of the building.

The storm window can now be unfolded and the remaining turnbuckles 13 are hooked to their corresponding hook screws 51. The above structure permits the storm window or screen to be placed in position from within a double hung window, for example as follows: The upper sash is lowered and the storm window is passed through the opening in folded position. Once outside, an inner panel is attached by hooking the free end of the upper mounting means, Turnbuckle 13 over the hookscrew 51, thus drawing that upper part of the panel against the outer surface of the wall. The spring biased or tightened turnbuckles to urge the panels aganst the outer surface of the wall as depicted in FIG. 8.

I Claim:

1. A foldable window unit adapted to be installed outside a building around a window from a position within the building, said unit comprising at least two rigid rectangular panels which when joined together are larger than the window to overlap outside edges of the window;

each panel including an outer rectangular frame, at least one of a rectangular transparent material, a rectangular screen material and the like, an inner rectangular frame clamping said rectangular material between said outer and inner frames, means securing said inner frame to said outer frame;

upper and lower brackets horizontally extending from one vertical sidewall of said inner frame to an opposite vertical sidewall of said inner frame, said brackets being vertically spaced from upper and lower walls of said inner frame;

hinge means securing said two panels together for permitting one panel to be folded with respect to the other panel to allow said window unit in a folded condition to pass through the window from the position within the building to the outside of the building, said hinge means being pivotally connected to adjacent vertical outer sidewalls of said outer frames of said rigid rectangular panels;

window securing means positioned within the window;

adjustable mounting means connecting said brackets of each panel to an associated one of said window securing means for drawing said panels against the outside edges of the window to fasten said window unit outside the building around the window;

said adjustable mounting means including a pair of turnbuckles associated with each of said panels, one end of each of said turnbuckles being connected to an associated one of said brackets of each of said panels and an opposite end of each of said turnbuckles being connected to its associated window securing means;

each of said brackets of said panels including slot means to allow positioning of said one end of each of said turnbuckles horizontally along its associated bracket between said one sidewall and said opposite sidewall of said inner frame of each of said panels; and said associated window securing means including one screw hook connected to said opposite end of each of said turnbuckles.

2. A foldable window unit as claimed in claim 1, wherein inner facing surfaces of said outer frame of each of said panels is provided with adjustable resilient padding means to allow for irregularities in outside wall of the building for insulating the window.

3. A foldable window unit as claimed in claim 1, wherein said rectangular material is fabricated from a thin, pliable plastic material.

4. A foldable window unit as claimed in claim 1, wherein said rectangular material is fabricated from a glass material.

5. A foldable window unit as claimed in claim 1, wherein said rectangular material is fabricated from a screen material.

* * * * *